US006986205B2

(12) United States Patent
Vrana

(10) Patent No.: US 6,986,205 B2
(45) Date of Patent: Jan. 17, 2006

(54) COMPOSITE STRUCTURAL MEMBER

(76) Inventor: Jan Vrana, 111 Vanguard Avenue, Pointe Claire, Québec (CA), H9R 3T4

( * ) Notice: Subject to any disclaimer, the term of this patent is extended or adjusted under 35 U.S.C. 154(b) by 48 days.

(21) Appl. No.: 10/160,020

(22) Filed: Jun. 4, 2002

(65) Prior Publication Data

US 2002/0144484 A1 Oct. 10, 2002

Related U.S. Application Data

(62) Division of application No. 09/561,922, filed on May 1, 2000, now Pat. No. 6,457,292.

(51) Int. Cl.
*B21D 47/00* (2006.01)

(52) U.S. Cl. ..... 29/897.3; 29/432; 29/432.2; 29/469.5; 29/513; 29/897.31; 29/897.34; 29/897.35

(58) Field of Classification Search ..... 29/430, 29/432, 432.2, 469.5, 513, 897, 897.1, 897.3, 29/897.31, 897.312, 897.33, 897.34, 897.35; 52/729.5, DIG. 6; 411/461, 466, 467, 468
See application file for complete search history.

(56) References Cited

U.S. PATENT DOCUMENTS

| | | | | | |
|---|---|---|---|---|---|
| 420,201 | A | * | 1/1890 | Hodges | 52/729.2 |
| 2,020,348 | A | * | 11/1935 | Bebie | 29/432 |
| 2,886,857 | A | * | 5/1959 | Karl | 52/730.7 |
| 2,889,614 | A | * | 6/1959 | Seely | 29/897 |
| 3,210,815 | A | * | 10/1965 | Breuning | 24/20 EE |
| 3,540,116 | A | * | 11/1970 | Bohnsack et al. | 29/430 |
| 3,722,052 | A | * | 3/1973 | Toti | 29/897.35 |
| 4,047,354 | A | | 9/1977 | Sutherland | |
| 4,253,227 | A | * | 3/1981 | Bullington | 29/458 |
| 4,281,497 | A | | 8/1981 | Luotonen | |
| 4,347,642 | A | * | 9/1982 | Bauer et al. | 15/250.351 |
| 4,555,879 | A | * | 12/1985 | Cheater | 52/90.1 |
| 4,653,242 | A | * | 3/1987 | Ezard | 52/737.3 |
| 4,738,071 | A | | 4/1988 | Ezard | |
| 4,937,998 | A | * | 7/1990 | Goldberg | 52/729.5 |
| 5,058,345 | A | * | 10/1991 | Martinez | 52/309.11 |
| 5,476,704 | A | * | 12/1995 | Kohler | 428/119 |
| 5,809,735 | A | * | 9/1998 | Leblanc | 52/737.3 |
| 5,833,421 | A | * | 11/1998 | Lees et al. | 411/466 |
| 5,875,603 | A | * | 3/1999 | Rudd | 52/731.8 |
| 5,875,604 | A | * | 3/1999 | Rudd | 52/731.8 |
| 5,875,605 | A | * | 3/1999 | Rudd | 52/731.8 |
| 5,881,529 | A | * | 3/1999 | Rudd | 52/737.3 |
| 5,896,716 | A | * | 4/1999 | Jalla | 52/514 |

(Continued)

FOREIGN PATENT DOCUMENTS

| | | | |
|---|---|---|---|
| EP | 099162 | * | 1/1984 |

*Primary Examiner*—Essama Omgba

(57) ABSTRACT

A method for making a composite structural member. The composite structural member has a flange having a base wall and two side walls extending from the base wall, the base wall and side walls forming a pocket to receive a portion of a web. Each side wall of the flange is doubled with an inner wall panel and an outer wall panel joined along a fold line spaced from, and parallel to, the base wall. Fasteners are formed from each side wall adjacent the fold line, each fastener having inner and outer wall panel sections joined by a section of the fold line and extending transversely from its side wall toward the other side wall. The flange is used with the web, a portion of the web mounted in the pocket with the side walls of the flange adjacent the sides of the web and the fasteners pressed into the sides of the web to secure the flange to the web. The method comprises the steps of: mounting the web within the pocket of the flange to form an elongated assembled unit; moving the unit longitudinally; forming the fasteners in the side walls while the side walls diverge from the web and the unit moves; and then moving the side walls against the web to press the fasteners into the web while the unit moves to secure the flange to the web.

12 Claims, 3 Drawing Sheets

U.S. PATENT DOCUMENTS 5,921,054 A * 7/1999 Rudd ..... 52/731.8
5,946,879 A 9/1999 Pellock
6,047,516 A * 4/2000 Taylor ..... 52/715
6,134,859 A * 10/2000 Rudd ..... 52/737.3
6,161,361 A * 12/2000 Ehrenkrantz ..... 52/731.9
6,167,675 B1 * 1/2001 LeBlanc ..... 52/737.3
6,189,193 B1 * 2/2001 Levey ..... 29/417
6,250,042 B1 * 6/2001 Rudd ..... 52/731.8
6,299,378 B1 * 10/2001 Griffith ..... 403/293
6,301,857 B1 * 10/2001 Vrana ..... 52/730.1
6,381,824 B1 * 5/2002 Levey ..... 29/417
6,412,248 B1 * 7/2002 Rudd ..... 52/731.8
6,416,269 B1 * 7/2002 Martel et al. ..... 411/461
6,457,292 B1 * 10/2002 Vrana ..... 52/729.5
6,516,584 B1 * 2/2003 Rudd ..... 52/731.8

* cited by examiner

COMPOSITE STRUCTURAL MEMBER

CROSS-REFERENCES TO RELATED APPLICATIONS

This application is a divisional application of application Ser. No. 09/561,922, filed May 1, 2000 now U.S. Pat. No. 6,457,292.

BACKGROUND OF THE INVENTION

1. Field of the Invention

This invention is directed toward a method for making the composite structural member employing a flange member.

The invention is further directed toward an apparatus for use in making the composite structural member.

2. Description of the Related Art

Composite structural members, such as I-beams, are known. These composite structural members usually have separate flanges joined to a central web in making beams, particularly I-beams. The materials usually employed, in both the flanges and webs, are wood; wood-based, engineered products such as plywood; and metal such as steel. Composite structural members employing metal flanges with a wooden web are efficient and cost-effective. The wooden web provides a desirable insulation factor, compared to a metal web and allows openings to be easily made through it for services. The metal flanges provide high strength and stability for the member. In addition the metal flanges can be provided with integral fasteners formed by punching teeth out of the flanges. The teeth can be easily pressed into the web to securely join the flanges to the web.

One form of a composite structural member employing a wood-based web and metal flanges is shown in U.S. Pat. No. 4,281,497. Each metal flange member is formed with side walls extending from a base. Fasteners are usually formed integrally in the side walls of the flange. An edge of the web is located against the base and the side walls of the flange, with the fasteners formed therein, are bent about the base against the web to form a pocket to receive an edge portion of the web. At the same time the fasteners in the side walls are pressed into the web to fasten the flange to the web. In this construction, the fasteners are formed in the flange, in a separate operation, before the flange and web are assembled. This additional step makes the assembling of the composite member relatively expensive.

It is preferred to have the side walls of the flange member doubled so as to have the pocket formed by side walls and base of the flange, which pocket receives an edge portion of the web, more rigid and thus more likely to tightly confine the web making the bearing capacity of the web stronger and thus making the composite member stronger. An example of such a construction is shown in U.S. Pat. No. 4,937,998. However, using metal flange members, with doubled side walls, with a wooden web, and with integral fasteners in the doubled side walls, is expensive. Openings must be provided in the inner wall panel of the doubled side wall to allow passage of the integral fasteners formed in the outer panel of the doubled side wall. The integral fasteners, and the openings for the fasteners, are formed in the flange in a separate operation, before assembly of the flange and web, again making the assembly relatively expensive.

Both types of composite members described above have the fasteners, joining the flange to the web, integrally formed in the flange in a single layer of sheet metal. The sheet metal layer must therefore be relatively thick to provide fasteners strong enough to penetrate the web. Using relatively thick sheet metal flanges, which may be thicker than the thickness required to provide the necessary strength for the composite member, increases the cost of the members.

SUMMARY OF THE INVENTION

It is the purpose of the present invention to provide a method of assembling a flange to a web in the making of a composite structural member, which method involves the step of forming integral fasteners in the side walls of the flange while assembling the flange to the web.

It is a further purpose of the present invention to provide a machine for assembling a flange to a web in the construction of a composite structural member. The machine forms fasteners in the side walls of a flange while moving the flange and web together as a unit, the fasteners then being used to connect the flange to the web.

The invention is particularly directed toward a method of making a composite structural member comprising providing an elongated metal flange having a pocket, the pocket formed by two side walls extending from a base wall; and an elongated web, made of fastener penetrable material, having opposed narrow edges. A portion of the web is mounted within the pocket of the flange with one edge abutting the base wall to form an assembled unit. The assembled unit is then fed in a longitudinal direction. Fasteners are then formed from the side walls of the flange while the side walls diverge from the web. The side walls are then moved against the web to press the fasteners into the web to securely join the flange to the web.

In a preferred embodiment, the side walls of the flange are doubled, each side wall has inner and outer wall panels, the wall panels joined along a fold line spaced from the base wall. The fasteners are integrally formed in the side walls adjacent the fold line, punched out along a line that intersects the fold line, and then bent laterally from the side wall.

The invention is further particularly directed toward a machine for use in making a composite structural member from an elongate web made from fastener penetrable material, the web having opposed narrow edges, and an elongate metal flange having side walls and a base wall joining the side walls to form a pocket for receiving a portion of the web. The machine has an elongated support table for supporting an assembled unit, comprising the flange with the web therein, for movement in the longitudinal direction of the unit. The machine has drive means on the table for moving the unit in the longitudinal direction. Forming means are on the table to form fasteners in the side walls of the flange while the side walls diverge from the web. Pressing means are on the table, downstream from the forming means, for moving the side walls of the flange against the web to cause the fasteners, integrally formed in the side walls, to enter the web and join the flange to the web as the unit is moved forwardly.

DESCRIPTION OF THE PREFERRED EMBODIMENTS

Figure 1:
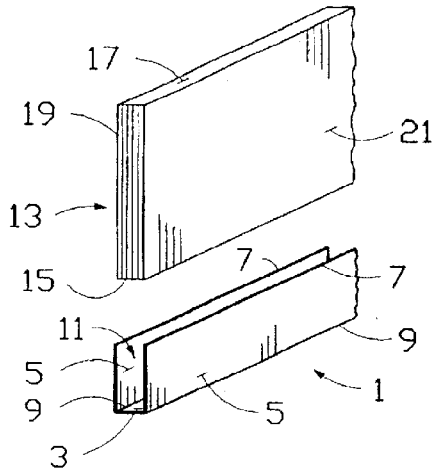
FIG. 1 is a perspective view of a web and one type of flange used in the making of a composite structural member.

The flange 1 used in the present invention has a base wall 3 with a pair of side walls 5, 5 extending laterally from the base wall 3 as shown in FIG. 1. The side walls 5 each have inner and outer edges 7, 9, with the inner edges 9 joined to the base wall 3. The base 3 and side walls 5, 5 form a pocket 11 for receiving a web 13. The web 13 has narrow, opposed, edges 15, 17 and wide parallel, sides 19, 21 joined the edges 15, 17. Both the flange 1 and web 13 are elongated structures with the flange 1 being made from suitable metal material, such as steel sheet or aluminum by way of example. The web 13 is made from suitable, fastener-penetrable material, such as wood or a wood based, engineered product. The web can, for example, be made from plywood or OSB (Oriented Strand Board). Or the web can be made from a mixture of wood particles and suitable plastic material pressed or molded together.

Figure 2:
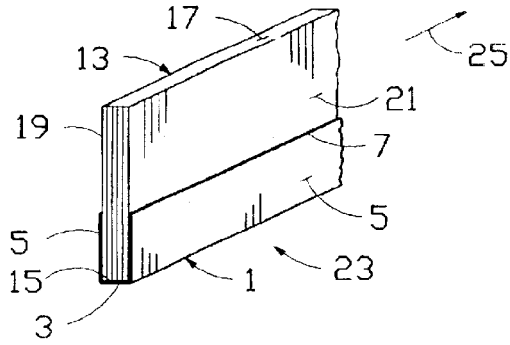
FIG. 2 is a perspective view of the web and flange assembled to provide the composite structural member.
Figure 4:
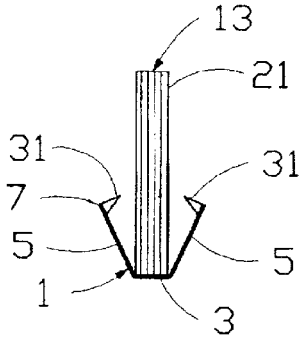
FIG. 4 is a cross-section view showing the fasteners formed in the spread-apart side walls.
Figure 5:
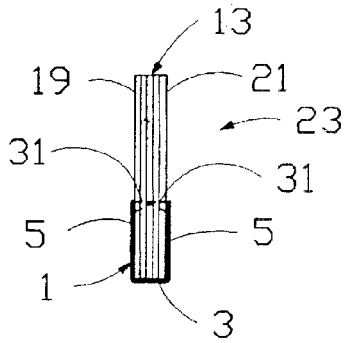
FIG. 5 is a cross-section view showing the web and flange assembled to form the composite structural member.

The web 13 is assembled with the flange 1 by inserting an edge portion of the web into the pocket 11 of the flange 1 so that one edge 15 of the web abuts the base wall 3, and the side walls 5, 5 of the flange 1 are adjacent the sides 19, 21 of the web 13, as shown in FIG. 2. The assembled unit 23 is then fed forward longitudinally as shown by the arrow 25 in FIG. 2. As the unit 23 is fed forwardly, the side walls 5, 5 of the flange 1 are spread apart from the web 13 as shown by the arrows 27 in FIG. 3 and fasteners 31 are then formed from the side walls 5, 5 as shown in FIG. 4. The fasteners 31 are preferably punched out of the side walls and bent inwardly toward the web 13, the fasteners 31 being triangular shaped and pointed. The side walls 5, 5 are spread apart a sufficient distance from the web 13 to allow room for the formation of the fasteners 31. The fasteners 31 are normally formed near the outer edge 7 of the side walls 5, 5. The fasteners 31 can be formed during the forward movement of the unit 23 or the unit 23 can be moved forwardly intermittently and the fasteners 31 formed during stoppage in movement of the unit. Once the fasteners 31 have been formed, the side walls 5, 5 are moved back against the sides 19, 21 of the web 13 with the fasteners 31 being pressed into the web 13 to securely join the flange 1 to the web 13 to form a composite structural member 33 as shown in FIG. 5.

Figure 3:
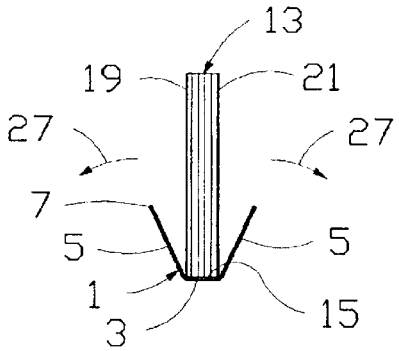
FIG. 3 is a cross-section view showing the side walls of the flange spread apart from the web.

The flange 1 may be provided from the factory with the side walls 5, 5 already spread-apart, as shown in FIG. 3, instead of with the side walls 5, 5 parallel, or nearly so, as shown in FIG. 2. When the flange 1, with the spread-apart side walls 5, 5, is assembled with the web 13, the unit 23 is moved forwardly to form the fasteners 31 in the already spread-apart side walls 5, 5 of the flange 1.

The flange may be assembled to the web at the factory where the flange is formed to shape, or at a building site. If the assembling occurs at the building site, the flanges, since they do not yet have the fasteners formed therein, can be compactly stacked and thus less expensively shipped from the factory to the building site.

Figure 6:
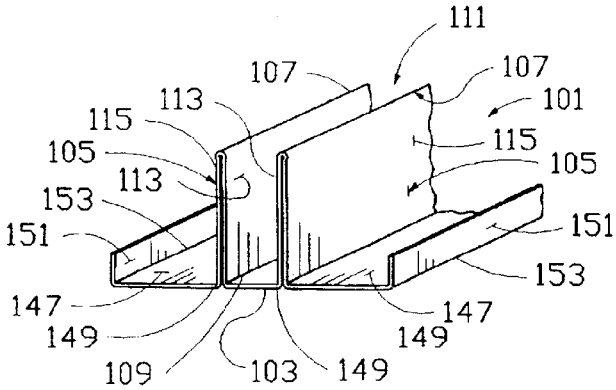
FIG. 6 is a perspective view of a preferred flange used in the making of the composite structural member.

In a preferred use, the flange has doubled side walls, and the fasteners are formed in the outer edge of the side walls. As shown in FIG. 6, the preferred flange 101 has a base wall 103 and side walls 105, 105, as before. Each side wall has an outer edge 107 and an inner edge 109, the inner edges 109 joined to the base wall 103. The base wall 103 and the side walls 105, 105 form a pocket 111 for receiving the web 13. Each side wall 105, 105 has an inner wall panel 113 and an outer wall panel 115. The inner edge of the inner wall panel 113 is joined to the base wall 103 by a fold line forming inner edge 109. The outer edge of the inner wall panel 113 is joined to the outer edge of the outer wall panel 115 by a fold line forming the outer edge 107 of the side wall 105.

Figure 7:
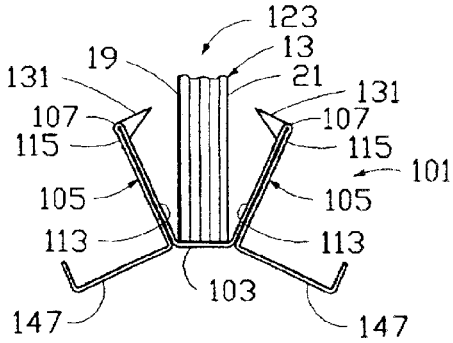
FIG. 7 is an end view showing the side walls of the preferred flange spread-apart with fasteners formed therein.
Figure 8:
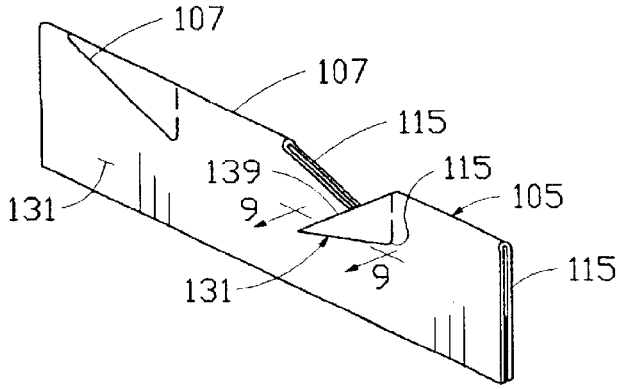
FIG. 8 is a partial perspective view of a section of side wall showing the formation of the fasteners.
Figure 9:
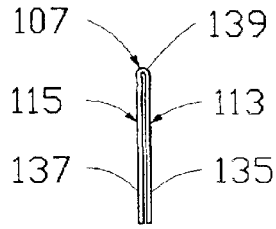
FIG. 9 is a cross-section view taken along line 9—9 in FIG. 8.

The flange 103 and the web 13 are assembled, as before, into a unit 123 which is fed forwardly longitudinally. As the assembled unit 123 is fed forwardly, the side walls 105, 105 of the flange 103 are spread apart from the web 13 and fasteners 131 are integrally formed from each side wall as shown in FIG. 7. The fasteners 131 are preferably formed by cutting the side wall 105 along a line 133 that angles to, and intersects, the fold line 107 as shown in FIG. 8. The cut can be made by punching the side wall with a punch. The triangular shaped tooth 131, formed by the cut, is then bent inwardly from the plane of the side wall 105 toward the web 13. The tooth 131 has wall sections 135, 137, formed from the inner and outer wall panels 113, 115 respectively, as shown in FIG. 9, and joined by a section 139 of the fold line 107. The tooth 131 is very strong, being double-walled. Once the teeth 131 have been formed, the side walls 105, 105 are moved back against the sides of the web 113, the teeth 131 simultaneously pressed into the web 13 to securely join the flange 101 to the web 13.

Figure 10:
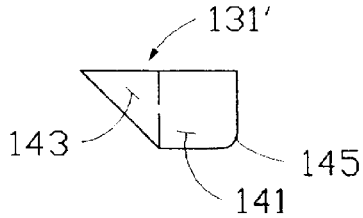
FIG. 10 is a detail plan view of another fastening tooth.

The fasteners 131 on one side wall preferably alternate, in a longitudinal direction, with the fasteners on the other side wall. The fasteners 131 have been shown as being triangular in shape, but they could have other shapes as well. For example, the fasteners 131', as shown in FIG. 10, could have a rectangular shaped main body 141 with a pointed free end portion 143 extending from one short side of the main body 141. The inner end of the main body portion is preferably rounded toward the outer edge, as shown at 145 in FIG. 10, to minimize tearing of the wall panels in this area. Similar rounding could be employed at the base of the triangular shaped tooth 131 as shown in FIG. 8.

The flange 101 shown in FIG. 6 is particularly suited for making flanges that can be used to make I-beam composite members. The I-beam flanges have wing panels 147 extending laterally from the bottom edge of the outer wall panels 115 of the side walls 105, the wing panels 147 aligned with each other and with the base wall 103. The wing panels 147 are joined to the outer wall panels 115 along a fold line 149. A narrow stiffening panel 151 can extend laterally from the free end of each wing panel 147, the stiffening panel 149 parallel to the side wall panels 115 and joined to the wing panels 147 along a fold line 153.

Figure 11:
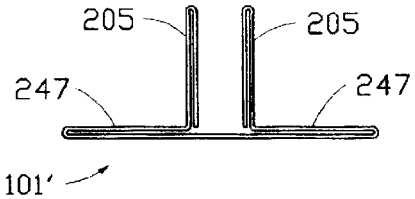
FIG. 11 is an end view of another embodiment of a flange.

While one form of flange 101, with single wing panels 147 and doubled side walls 105, has been described, other forms of flanges can be employed. For example, the flange 101' can have doubled side walls 205, 205 and doubled wing panels 247, 247 as shown in FIG. 11.

Figure 12:
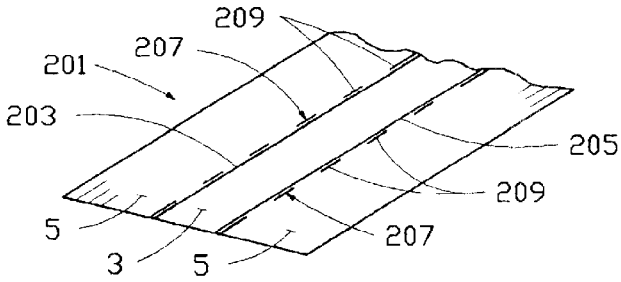
FIG. 12 is a partial perspective view of a panel used to make the flange shown in FIG. 1.

The flanges can be easily, partly formed off-site, without the fasteners formed therein, and then shipped to the site for making composite structural members. The flange 1, for example, can be formed by bending an elongate panel 201, as shown in FIG. 12, along fold lines 203, 205 to form base wall 3 and side walls 5, 5. The fold lines 203, 205 define the bottom edge 9 if the side walls 5, 5. Lines 207 of incisions 209 can be provided in the panel 201 adjacent each fold line 203, 205 location, before folding, so as to facilitate folding. The incisions 209 can be right at the fold or just on either side of it. The flanges can be folded to have the side walls 5, 5 generally parallel, as shown in FIG. 1, or to have the side walls 5, 5 diverging slightly, as shown in FIG. 3. The folded flanges 1, in either form, can be easily nested and efficiently shipped to the work site.

Figure 13:
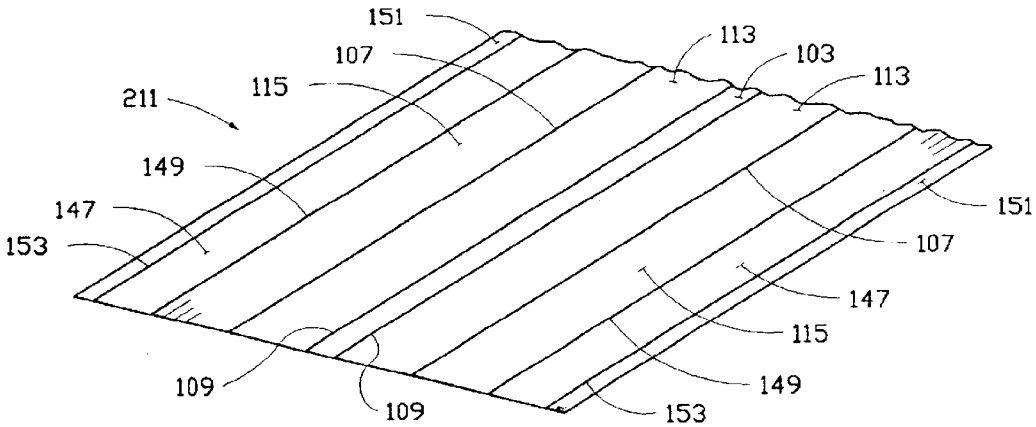
FIG. 13 is a partial perspective view of a panel used to make the preferred flange shown in FIG. 6.

The flange 101 can be formed from a single panel 211, as shown in FIG. 13, bent along fold lines 109 to form the base wall 103 and side walls 105, 105. Each side wall 105 has inner and outer panels 113, 115, the panels joined by fold lines 107. The wing panels 147 are joined to the bottom of the outer panels 115 by fold lines 149. Lines of incisions, not shown, can be used to facilitate folding along the fold lines.

Figure 14:
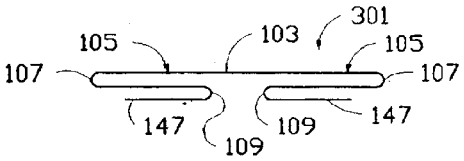
FIG. 14 is an end view of another partially formed flange.

The flanges 101, with the wing panels 147, could be partly folded off-site to produce the article 301 shown in FIG. 14. In this article, the doubled side walls 105, 105 have not been folded up from the base wall 103 and the article 301 is flattened to make shipping easier. At the work site, the side walls 105, 105 are partly folded up toward the web, the fasteners formed, and the composite structural member completed by completing folding of the side walls against the sides of the web.

Figure 15:
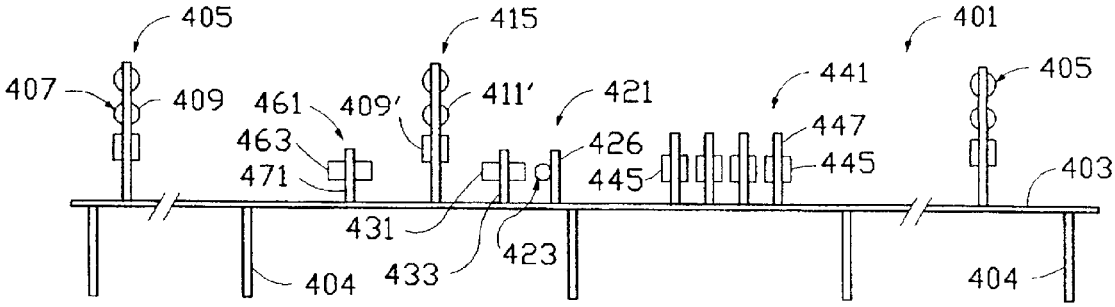
FIG. 15 is a side view of an apparatus used to make the composite structural member.
Figure 16:
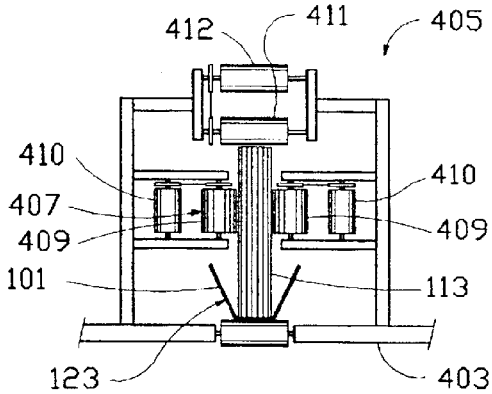
FIG. 16 is a cross section view taken along line 16—16 in FIG. 15.

An apparatus is provided for making the composite structural member described. The apparatus 401, as shown in FIGS. 15 and 16, has an elongated, work table 403 maintained in a horizontal position by legs 404. Feeding means 405 are provided on the work table 403 for feeding the assembled unit 123 of the flange 101, with diverging side walls, and the web 113, in a longitudinal direction on the work support. The feeding means 405 can comprise sets 407 of side drive rollers 409, the sets spaced along the length of the feed path. There is a drive roller 409 in each set on each side of the web 113, the drive rollers contacting the web to feed it forwardly. The axis of these side rollers 409 is parallel to the sides of the web 113, the rollers 409 located above the flange 101 to be able to contact the web. The side drive rollers 409 are driven by suitable motor means 410. The feeding means 405 can also include top, drive rollers 411 biased against the top edge of the web 113, and driven by suitable motor means 412, to feed it forwardly. The assembled unit 123 rides on support rollers 413, mounted for free rotation in openings in the table 403. If desired, some of the guide rollers 413 could also be driven by suitable motor means, not shown. Guide roller sets 415, similar to the drive roller sets 407, but with guide rollers 409', 411' instead of drive rollers, could also be provided on the table 403 along the feed path for guiding the assembled unit 123 during its movement along the table in a longitudinal direction on the support rollers.

Figure 17:
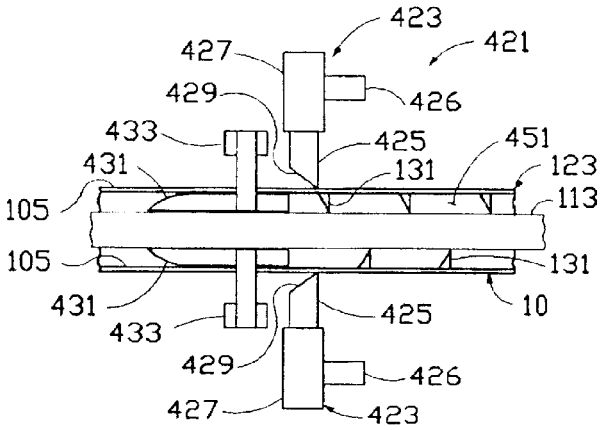
FIG. 17 is a detail plan view of a portion of the apparatus showing the forming station.
Figure 20:
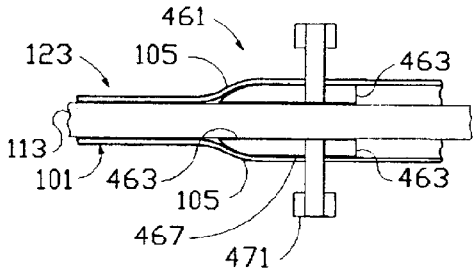
FIG. 20 is a detail plan view showing the spreading station.

The apparatus includes a first forming station 421, as shown in FIGS. 15 and 17, where the fastening means on each side wall of the flange are formed. Fastener forming means 423 are provided at the forming station 421, one on each side of the path of travel of the assembled unit to form fasteners from the side walls of the flange. The forming means 423 can include a punch 425 that is located above the table, by a support 426 at a height to partially punch out a fastener 131 out of the side wall. The punch 425 preferably is adjustable in height on the on the table and preferably is located to punch out the fastener adjacent the outer edge of the side wall of the flange. The punch 425 is operated by a hydraulic cylinder 427 or other suitable operating means and has a cutting edge 429 for cutting the side wall along the desired line to define the fastener. Continued forward movement of the punch after cutting bends the fastener out of the plane of the side wall. The forming station 421 includes an anvil plate 431 on each side of the unit, the plate 431 on each side supported by a support arm 433 on the table 403. The anvil plate 431 is located between the side wall 105 and the web 113, just in front of the punch 425, and supports the side wall 105 during punching of the fastener 131. A portion of the anvil plate 431 can extend forwardly of the punch 425, beneath the punch, if desired, to provide additional support for the sidewall.

Figure 18:
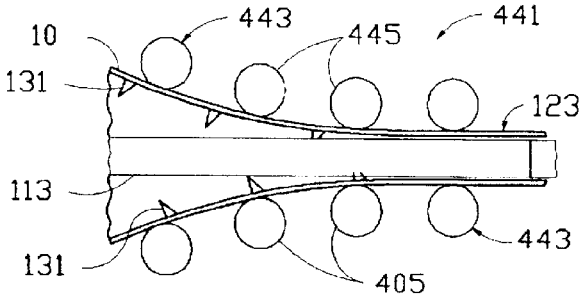
FIG. 18 is a detail plan view of another portion of the apparatus showing the press station.
Figure 19:
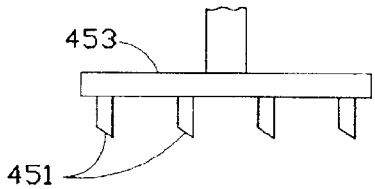
FIG. 19 is a detail plan view of another embodiment of the forming element.

Once the fasteners 131 have been formed on each side wall at the forming station 421, continued movement of the assembled unit 123 brings it to a press station 441 as shown in FIGS. 15 and 18. The press station 441 can comprise sets 443 of press rolls 445 on each side of the unit which are sized, shaped and positioned to gradually move the spread-apart side walls 105, 105 of the flange 101 against the web 113 while pressing the fasteners 131 into the web 113 to securely fasten the flange 101 to the web 113. The press rolls 445 are supported by supports 447 on the table 403.

While the assembled unit 123 is fed to the forming station 421, the side walls 105, 105, diverging from the web 113, provide a space 451 between the side walls and the web for the anvil 431 on each side. The punch 425 is periodically operated to punch a fastener out of the side wall just after it leaves the anvil so the side wall is partly supported while the fastener is being formed. The assembled unit can be moving while the punch is actuated. Alternatively, the unit can be periodically stopped to allow the punch to operate while the unit is stationary.

In one embodiment, the forming station 421 can have a gang of punches 451 mounted on a support plate 453 which support plate is movable by suitable moving means, not shown, to have the gang of punches simultaneously punch a set of fasteners out of the side walls. In this embodiment, the assembled unit is stopped and moved intermittently. The press rollers 445 on each side of the unit at the press station 441 could also be replaced by an elongated press pad, not shown, moved inwardly to press the side walls, and the fasteners, against the web. The press pad would operate at the same time that the gang of punches 451 are operated while movement of the unit is stopped.

The machine preferably includes a diverging station 461 in front of the forming station 421. The diverging station 461 spreads the side walls 105, 105 of the flange 101 in the assembled unit 123 apart from the web 113, if the flange is provided with parallel side walls from the factory. The diverging station 461 has tapered guide plates 463 located between the web and the side walls, one face 465 of the plate 463 on each side flat against the side of the web, the other face 467 angled outwardly to move the side walls away from the web and to thus provide the space 451 for the anvils 431 at the forming station 421. The guide plates 463 are carried by support means 471 fastened to the table 403.

Suitable, programmable, control means can be provided to operate the machine to form the fasteners at the desired locations in the flange. While the apparatus has been shown fastening flange 101 to web 113 it can also be used to fasten flange 1 to web 13.

The method of making the composite structural member is relatively inexpensive since the folding of the material, to form the flanges, can be done offsite at high speed and thus very efficiently. The forming of the fasteners, which is slower, takes place on-site during the assembly of the composite structural unit. It will be seen that the fasteners are formed during assembly of the flange to the web so that a separate fastening forming step, with attendant handling of the flange, is eliminated, thus leading to further efficiencies and less expense.

The flanges with doubled side walls provide very strong fastening members since the fastening members formed from the side walls are also doubled walled and joined together. The double walled side walls also make the flange stronger; allows the use of thinner sheet material; and retains the shape of the pocket better thus forming a stronger connection between the web and the flange and making for a stronger composite structural unit.

It is to be understood that while only one flange has been described as being attached to the web to form the structural unit, a second flange is usually attached to the other edge portion of the web, in a similar manner, but in a second operation, to form a balanced structural member such as an I-beam.

I claim:

1. A method of making a composite structural member comprising:

providing an elongated flange having a pocket, the pocket formed by two side walls extending from a base wall; the flange having no fasteners formed therein:

providing an elongated web having opposed narrow edges;

mounting a portion of the web within the pocket of the flange with one edge of the web abutting the base wall of the flange to form an elongated, assembled unit;

feeding the assembled unit in a longitudinal direction the unit passing a first station while being fed longitudinally and forming fasteners from the side walls of the flange while the side walls are diverging from the web at the first station, the fasteners integral with the side walls, and the unit immediately passing a second station after leaving the first station while being fed longitudinally, moving the side walls against the web at the second station to press the integral, formed, fasteners into the web to securely join the flange to the web.

2. A method as claimed in claim 1 wherein the assembled unit is stopped at the first station to form the fasteners while being fed in the longitudinal direction.

3. A method as claimed in claim 2 wherein each side wall of the flange has inner and outer wall panels joined by a fold line spaced from the base wall.

4. A method as claimed in claim 3 wherein the fasteners are formed adjacent the fold line in each side wall, each fastener including a portion of the fold line.

5. A method as claimed in claim 4 including the step of spreading the side walls away from the web during feeding of the unit before the fasteners are formed.

6. A method as claimed in claim 5 wherein each fastener is formed by cutting the side wall along a line that angles to, and intersects, the fold line, the cut line and fold line defining a side wall portion between them and then bending the side wall portion toward the other side wall.

7. A method as claimed in claim 4 wherein the fasteners are formed by punching out the fasteners from the side walls.

8. A method as claimed in claim 4 wherein each fastener is formed by cutting the side wall along a line that angles to, and intersects, the fold line, the cut line and fold line defining a side wall portion between them and then bending the side wall portion toward the other side wall.

9. A method as claimed in claim 2 including the step of spreading the side walls away from the web during feeding of the unit before the fasteners are formed.

10. A method as claimed in claim 2 wherein the fasteners are formed by punching out the fasteners from the side walls.

11. A method as claimed in claim 2 including the step of spreading the side walls away from the web during feeding of the unit before the fasteners are formed.

12. A method as claimed in claim 1 wherein the assembled unit is fed continuously longitudinally to the first and second stations.

* * * * *